US008161577B2

(12) United States Patent
Tews

(10) Patent No.: US 8,161,577 B2
(45) Date of Patent: Apr. 24, 2012

(54) HELMET WITH IMPROVED SHIELD MOUNT AND PRECISION SHIELD CONTROL

(75) Inventor: Erik H. Tews, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 917 days.

(21) Appl. No.: 12/194,594

(22) Filed: Aug. 20, 2008

(65) Prior Publication Data

US 2009/0044317 A1 Feb. 19, 2009

Related U.S. Application Data

(63) Continuation of application No. 11/834,188, filed on Aug. 6, 2007, now Pat. No. 7,895,678.

(51) Int. Cl.
*A42B 1/08* (2006.01)

(52) U.S. Cl. ..... 2/424

(58) Field of Classification Search ..... 2/6.3, 6.5, 2/6.7, 424, 425
See application file for complete search history.

(56) References Cited

U.S. PATENT DOCUMENTS

| | | | | |
|---|---|---|---|---|
| 4,247,960 | A | 2/1981 | Nava | |
| 4,612,675 | A | 9/1986 | Broersma | |
| 4,794,652 | A * | 1/1989 | Piech von Planta et al. | 2/414 |
| 4,866,792 | A | 9/1989 | Arai | |
| 4,884,302 | A | 12/1989 | Foehl | |
| 5,182,816 | A | 2/1993 | Arai | |
| 5,329,642 | A * | 7/1994 | Dampney | 2/424 |
| 5,333,329 | A | 8/1994 | Hong | |
| 5,394,566 | A | 3/1995 | Hong | |
| 5,604,930 | A * | 2/1997 | Petit et al. | 2/6.5 |
| 6,047,409 | A * | 4/2000 | Simpson | 2/424 |
| 6,125,477 | A * | 10/2000 | Crippa et al. | 2/422 |
| 6,260,213 | B1 | 7/2001 | Eom et al. | |
| 6,425,143 | B1 | 7/2002 | Benedict et al. | |
| 6,842,913 | B1 * | 1/2005 | Song | 2/424 |
| 6,892,400 | B1 * | 5/2005 | Choi et al. | 2/424 |
| 6,931,670 | B2 | 8/2005 | Arai | |
| 6,954,944 | B2 | 10/2005 | Feher | |
| 7,036,152 | B2 * | 5/2006 | Gafforio et al. | 2/15 |
| 7,210,174 | B2 * | 5/2007 | Yeh | 2/424 |
| 7,398,561 | B2 * | 7/2008 | Kim et al. | 2/424 |
| 2003/0088907 | A1 * | 5/2003 | Gafforio et al. | 2/424 |
| 2003/0182716 | A1 * | 10/2003 | Wu | 2/424 |
| 2005/0273912 | A1 * | 12/2005 | Gafforio et al. | 2/424 |
| 2006/0206995 | A1 * | 9/2006 | Hong et al. | 2/424 |

(Continued)

OTHER PUBLICATIONS

Ron Ayers Motorsports internet catalog of parts and accessories, Apr. 16, 2007, pp. 1-2.

(Continued)

*Primary Examiner* — Shaun R Hurley
*Assistant Examiner* — Andrew Sutton
(74) *Attorney, Agent, or Firm* — Baker Botts L.L.P.

(57) ABSTRACT

A helmet includes a shell, an eyeport formed in the shell, a shield having inwardly projecting hubs, and a pair of sockets on the shell. The sockets are positioned and configured to receive and rotatably capture the inwardly projecting hubs of the shield so that the shield is hingable about the hubs between a closed position covering the eyeport and an open position displaced from the eyeport. Each of the sockets is generally oblong to facilitate insertion of said hubs into the sockets to mount the shield to the helmet and to facilitate removal of the hubs from the sockets to detach the shield from the helmet.

16 Claims, 8 Drawing Sheets

U.S. PATENT DOCUMENTS

| | | | | |
|---|---|---|---|---|
| 2008/0141429 | A1* | 6/2008 | Scharpenack et al. | 2/2.5 |
| 2009/0044317 | A1* | 2/2009 | Tews | 2/424 |
| 2009/0183302 | A1* | 7/2009 | Choi | 2/424 |

OTHER PUBLICATIONS

Epinions.com internet catalog of parts and accessories, Apr. 16, 2007, pp. 1-3.
Motorhelmets.com internet catalog of parts and accessories, Apr. 16, 2007, pp. 1-2.
Harley-Davidson internet catalog of parts and accessories, Apr. 16, 2007, p. 1.
Arai Helmets internet catalog of parts and accessories, Apr. 16, 2007, p. 1.
Shoei Helmets internet catalog of parts and accessories, Apr. 27, 2007, pp. 1-2.
HJC Helmets internet catalog of parts and accessories, Apr. 27, 2007, pp. 1-2.
Scorpion Sports internet catalog of parts and accessories, Apr. 27, 2007, pp. 1-2.

* cited by examiner

HELMET WITH IMPROVED SHIELD MOUNT AND PRECISION SHIELD CONTROL

REFERENCE TO RELATED APPLICATION

This is a continuation of U.S. patent application Ser. No. 11/834,188 entitled Helmet with Improved Shield Mount and Precision Shield Control, filed on Aug. 6, 2007, now U.S. Pat. No. 7,895,678, the entirety of which is hereby incorporated by reference.

TECHNICAL FIELD

This invention relates generally to helmets and more particularly to closed face motorcycle helmets with articulating and detachable face shields.

BACKGROUND

Many people wear protective safety helmets while enjoying outdoor riding activities such as snowmobiling, motorcycle riding, and bicycling. While such helmets vary widely in design and features, motorcyclists often choose a helmet design known as a "closed face" motorcycle helmet. A closed face motorcycle helmet has a hard shell that surrounds and covers a rider's head from the neck up and an eyeport through which the rider can see. A clear shield is hingedly attached to the sides of the helmet and can be flipped down to cover the eyeport for normal use or flipped up out of the way when desired. When the shield is covering the eyeport, a peripheral seal around the eyeport seals against the inside surface of the shield to prevent ingress of air, water, and debris into the interior of the helmet.

Under certain environmental conditions, the inner surface of the shield when closed and sealed is susceptible to condensation formation or "fogging," which can interfere with a rider's vision and thus must be eliminated. Helmet designers have used several methods to eliminate shield condensation. Such methods include, for example, coating the inside surface of the shield with a hydrophobic coating or designing a helmet vent system that directs outside air into the helmet and across the interior surface of the shield. However, hydrophobic coatings are somewhat but not completely successful and a shield vent system works only when the rider is moving. Another very effective method of clearing a shield fogged with condensation is simply to open the shield to allow outside air into the helmet. However, opening the shield too far while moving can allow high velocity air to hit the riders face and eyes, which is uncomfortable and dangerous. It thus is imperative when employing this method that the shield be opened or cracked by a small amount that is just enough to break contact between the shield and the peripheral seal around the eyeport. Cracking the shield slightly in this way admits a sufficient stream of outside air to clear condensation but does not allow an excessive airflow that might interfere with the rider's comfort or vision.

Most helmets incorporate shield set positions or "detents" through which the shield passes as it is moved from its closed position to its open position. In most cases, however, the first detent or first open position is too large for use in clearing a fogged shield because it allows high velocity air to hit the rider's face and eyes. Some more recent close faced helmets incorporate a mechanism for cracking the shield slightly when desired. The helmet manufacturer Arai, for example, incorporates a small sliding tab on the lower left edge of the helmet shield that, when slid forward, engages a feature on the periphery of the eyeport to cause the shield to rotate slightly upwardly from its closed position. While the Arai and similar systems represent steps in the right direction, they nevertheless tend to have inherent shortcomings. They can, for instance, be difficult to operate, particularly when a rider is wearing gloves.

Another problem encountered by motorcyclists wearing closed face helmets is that the shield of the helmet can accidentally fly open under certain circumstances. For instance, a rider may occasionally rotate his head to view objects outside of his peripheral vision. Similarly, an individual engaging in a high speed race may turn his head to check for other riders to his side or rear. At high speeds, these and similar motions may cause the shield to lift and fly open due to extreme and unbalanced aerodynamic forces.

Thus, there is a need for a closed face helmet with a highly reliable and effective mechanism for cracking the shield of the helmet slightly when desired to remove a condensation fog from the inside surface of the shield. There is a further need for a rider to be able to restrain the shield of the helmet so that it does not accidentally fly open at high speeds when the rider turns or raises his head. These needs should be met without interfering with the normal opening and closing operation of the helmet shield. In addition, the mechanism providing the needed functions should be easily operated even while wearing gloves, should be fail safe to prevent jamming, and should be automatically recoverable in the event of improper or unintended operation by a rider. It is to the provision of a helmet with precision shield control that satisfies all of these needs and more that the present invention is primarily directed.

SUMMARY OF THE INVENTION

Briefly described, the present invention, in one preferred embodiment thereof, comprises a closed face motorcycle helmet having an improved shield mounting system that insures smooth reliable movement of the shield between its closed and its open positions. The helmet further incorporates a novel multi-function shield control mechanism for selectively cracking the shield open slightly to remove condensation fog when needed and for restraining the shield against being blown open by aerodynamic forces. The mechanism includes a small lever rotatably mounted to the shell of the helmet just below the eye port, preferably on the left side of the helmet. The lever is coupled to a hub that has a pair of small dowels projecting therefrom. The lever and its hub can be moved between three functional positions, namely a neutral or home position, a forwardly rotated shield cracking position, and a rearwardly rotated shield restraining position. A corresponding motion plate is mounted to the lower edge of the helmet shield and is positioned such that the motion plate moves over and covers the hub of the lever when the shield is closed. The inside of the motion plate is formed with an array of ramps and surfaces that interact with the two dowels of the hub as the lever is moved between its three functional positions to provide the unique features of the invention.

When the lever and its hub are in the neutral or home position, the dowels of the hub are positioned such that the surfaces and ramps of the motion plate do not interact with the dowels. Thus, in the home position of the lever, the shield can be raised to its open position and lowered to its closed and sealed position in the usual way. With the shield closed, the lever can be flipped forward to its shield cracking position, which causes one of the dowels to rotate against a corresponding surface of the motion plate and impart an upward force to the shield. This causes the shield to raise slightly to break the seal between the shield and the eyeport and thus to admit fresh air for eliminating condensation on the inside of the shield. Thus, the lever can be flipped forward to crack the shield slightly. Return of the lever to the home position lowers and reseals the shield.

With the shield closed, the lever also can be flipped rearwardly to its shield retaining position. This causes one of the dowels of the hub to rotate into engagement with and bear with a predetermined force against a retention surface of the motion plate. The force of the dowel against the motion plate, in conjunction with the geometry of the retention surface, holds the shield more securely in its closed position to prevent the shield from being blown open accidentally by aerodynamic forces. Thus, the lever can be flipped rearward to restrain the shield against being blown open. Return of the lever to the home position removes the restraining force and allows the shield to operate in its normal manner.

The surfaces and ramps of the motion plate are further designed so that if the shield is opened manually by a rider when the lever is in its shield cracking position, one of the dowels of the hub is engaged by a corresponding surface of the motion plate in such a way that the hub and lever are flipped back to the home position. Similarly, if the lever is in its shield retaining position and the shield is opened manually by a rider with sufficient force to overcome the added retention force, the hub and lever are caused to be flipped back to the home position. Finally, if the shield is open and the lever is accidentally flipped to either its shield cracking position or its shield retaining position, then, when the shield is closed, reset surfaces formed on the motion plate engage a corresponding one of the dowels of the hub and cause the hub and lever to flip back to the home position. Thus, the precision control mechanism of the present invention is fail save in that it is assured that its lever always will reside in or be moved to the home position after the shield is opened by a wearer and after the shield is closed by a wearer. The lever is thus always ready for use to crack or retain the shield as needed and jamming of the mechanism due to accidental mis-positioning of the lever and consequent misalignment of the dowels with the motion plate is virtually eliminated. Finally, the lever is shaped and textured so that it can easily be flipped between its home, shield cracking, and shield retaining positions, even with a gloved hand, by simply swiping the left hand forward or rearward across the lever.

It thus will be seen that a helmet with improved shield mount and precision shield control is now provided that addresses successfully and uniquely the problems and shortcomings of the prior art. The above and additional features and advantages of the present invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
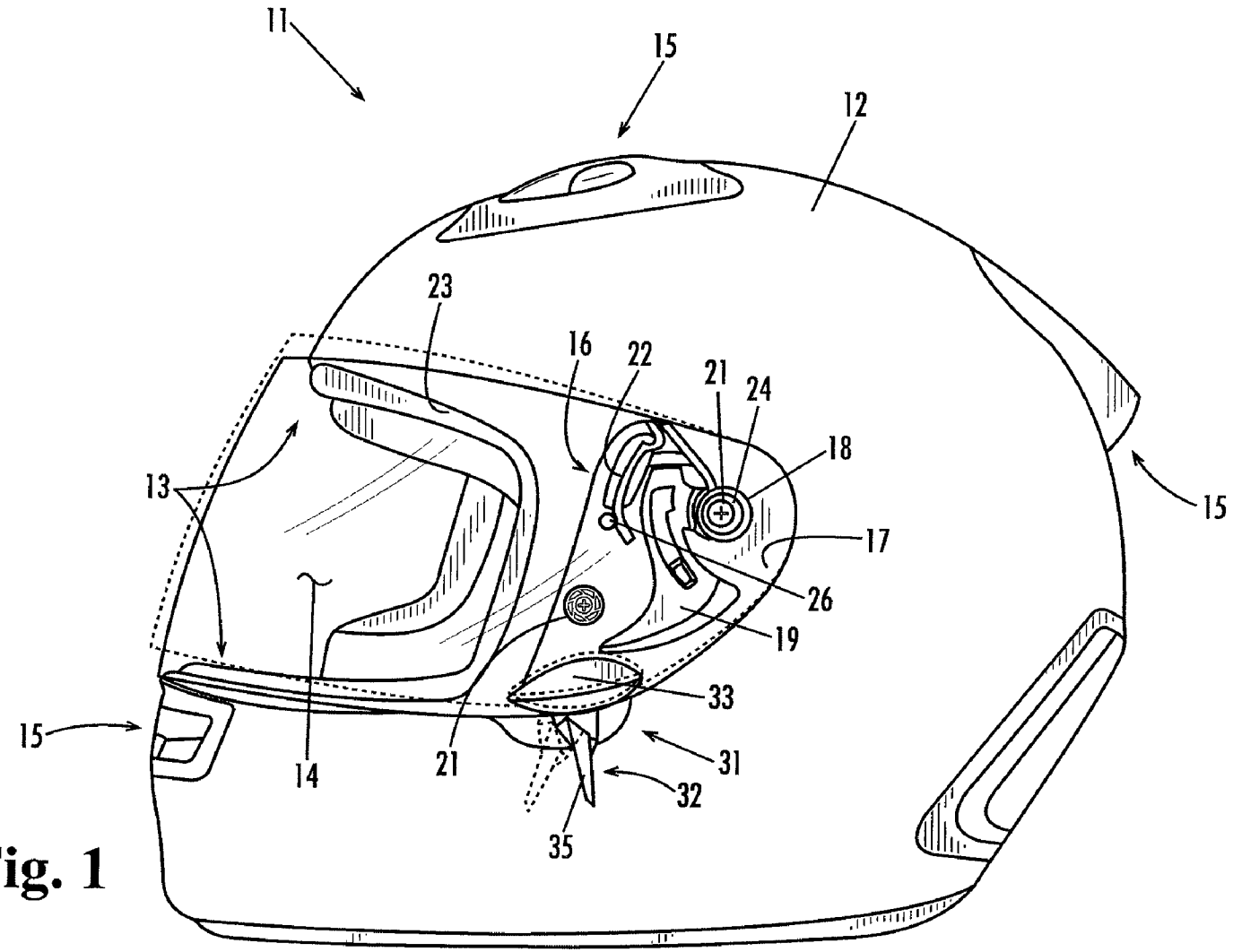
FIG. 1 is a left side elevational view of a helmet that embodies principles of the present invention in a preferred embodiment.

Referring now in more detail to the drawings, wherein like reference numerals indicate, where appropriate, like parts throughout the several views, FIG. 1 illustrates a closed face helmet 11 having a shell 12, an eyeport 13, and a clear shield 14. The shield 14 is detachably and pivotally attached to the helmet through a shield mount assembly generally indicated at 16, one of which is provided on each side of the helmet. The shield mount assembly 16 includes a hinge plate 17 that carries a socket 18 and a release lever 19. The shield 14 is formed on its inside surface with a flanged hub 24 that is rotatably disposed in the socket 18. This arrangement allows the shield 14 to be pivoted about is hubs 21 between a fully closed position covering the eyeport 13 and a fully open position displaced above and uncovering the eyeport 13. The release lever, which is spring loaded, retains the flanged hub 24 in the socket 18 but, when depressed rearwardly by a user, frees the hub from the socket so that the shield can be removed readily from the helmet.

The hinge plate also carries a flexible live beam 22 against which a protrusion 26 formed on the inside of the shield rides as the shield is moved between its open and closed positions. The surface of the live beam 22 is formed with an array of micro detents such that interaction between the protrusion 26 and the live beam 22 as the shield is raised or lowered imparts a fluid-like yet slightly detented feel and allows the user to position the shield at virtually any location between its fully opened and fully closed configurations.

The helmet 11 also includes, according to the present invention, a precision shield control mechanism 31. The control mechanism 31 will be described in detail below. Generally speaking, however, the control mechanism 31 includes a lever assembly 32 coupled to the hinge plate 17 and a motion plate 33 attached to the lower edge of the shield 14. The lever assembly 32 includes a lever 35 and a lever hub 34 (FIG. 2) formed with a rear dowel 36 and a front dowel 37. The lever assembly is rotatable about the axis of its hub 34 between three positions; namely, a home position (shown in solid line in FIG. 1), a forwardly extending shield cracking position (shown in phantom line in FIG. 1), an a rearwardly extending shield restraining position (not shown in FIG. 1). Movement of the lever assembly between these positions causes the dowels of the lever hub to interact with the motion plate, as described in detail below, to achieve certain shield control functions. More specifically, moving the lever forward from its home position to its shield cracking position when the shield is closed cracks the shield; that is, causes the shield to raise upwardly just enough to break contact with the seal 23 thereby allowing air to circulate into the helmet around the eyeport (the cracked position of the shield is illustrated in phantom line in FIG. 1). This is very effective at eliminating a condensation fog on the inside of the shield. Returning the lever back to its home position lowers the shield back to its fully closed and sealed configuration. Moving the lever rearwardly from its home position to its shield restraining position when the shield is closed restrains the shield; that is, imparts additional incremental closing force to the shield to insure that the shield will not fly open under the influence of aerodynamic forces when, for instance, a rider turns his head at high speeds. Returning the lever to its home position removes the additional closing force.

The unique configuration of the motion plate, detailed below, interacting with the dowels 36 and 37 provides other functions. For instance, if the lever is in either the shield cracking position or the shield restraining position and a user raises the shield manually, the lever assembly is automatically returned to its home position so that the shield can be closed without interference between the motion plate and the lever assembly. Similarly, if the lever assembly is accidentally moved to the shield cracking position or the shield restraining position while the shield is open, and the shield is subsequently closed manually by a rider, the motion plate 33 interacts with the dowels 36 and 37 as the shield closes to return or reset the lever assembly to its home position.

Figure 2:
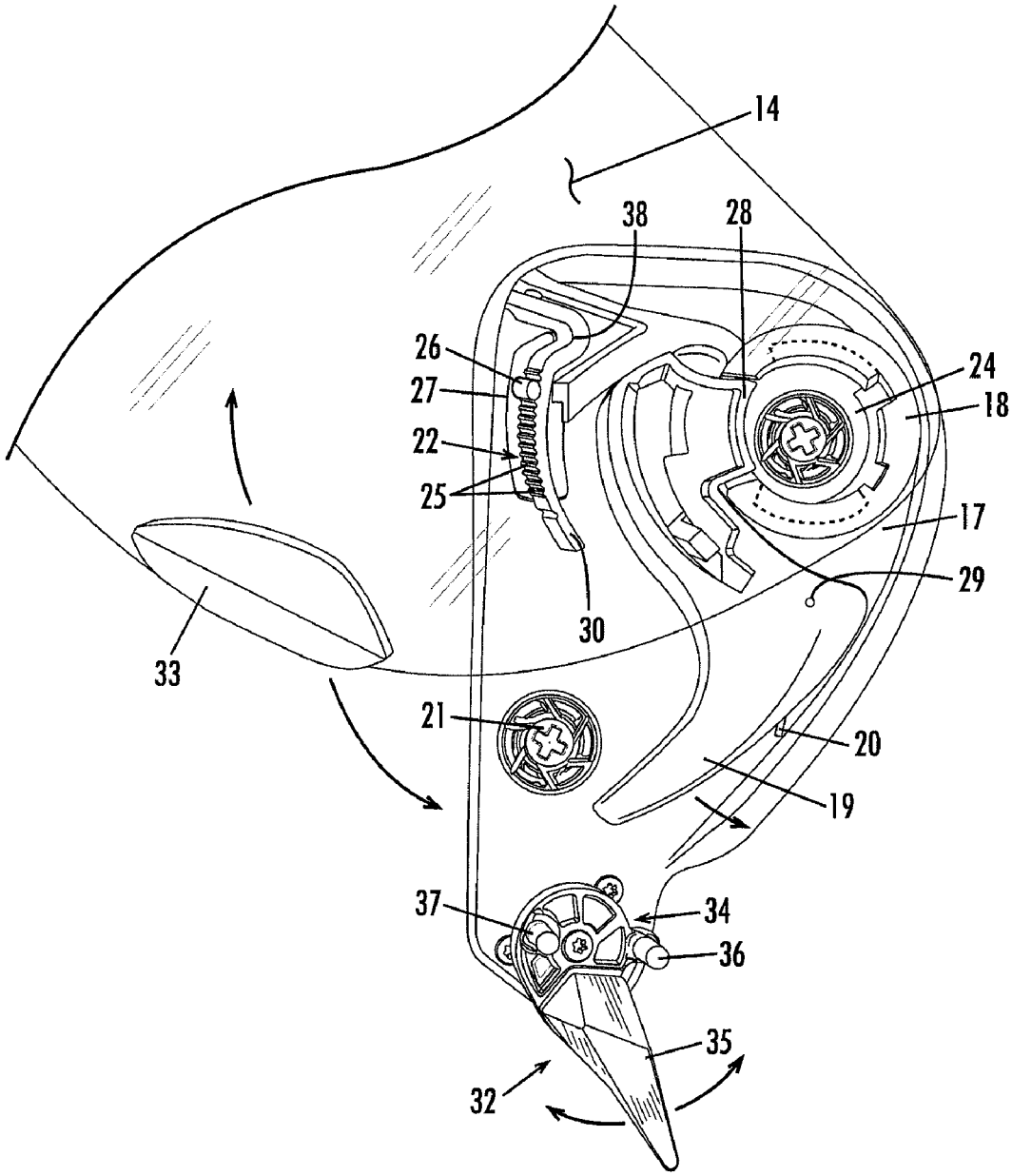
FIG. 2 is an enlarged perspective view of the shield mount and precision control system of the helmet of FIG. 1.

FIG. 2 is an enlarged illustration of the shield mount and control system of this invention. The clear shield 14 of the helmet is seen pivotally attached to shield mount by means of hub 24 of the shield rotatably journaled within socket 18 of the hinge plate 17. Shield 14 is illustrated in FIG. 2 in a position intermediate it fully closed and fully opened positions and the arrows above and below the motion plate 33 indicate the directions of pivotal motion of the shield. It will be seen that, as the shield 14 is raised and lowered, the motion plate 33 moves with the shield in an arcuate path respectively away from and toward the hub 34 and dowels 36 and 37 of the lever assembly 32. The release lever 19 is mounted to the hinge plate 17 so that can pivot about an axis 29. A torsion spring 20 is provided to bias the release lever 19 to a clockwise pivoted position. The release lever 19 is formed with a blade 28 that extends through a gap in the wall of the socket 18 to engage and capture the flanged hub 24 of the shield 14 within the socket. To remove the shield, the shield is raised to its open position and the release lever is pressed rearwardly as indicated by the arrow. This rotates the release lever in a counterclockwise direction about axis 29, which, in turn, retracts the blade 28 from the socket 18 thereby freeing the flanged hub 24 from the socket 18. The shield can then be removed from the helmet. To replace the shield, or to install another or different shield, the flanged hubs of the shield are aligned with sockets 18 on either side of the helmet and pressed into the sockets. This motion forces the blade to the left in FIG. 2 until the flanges of the flanged hubs move beyond the blades 28, whereupon the release levers snap back to capture and hold the flanged hubs in place within the sockets.

Live beam 22 is generally arcuate in shape and has an exposed surface formed with an array of micro detents 25, a larger closed position detent 30 near the bottom of the beam 22, and a still larger open position detent 38 at the top end of the beam 38. Live beam 22 preferably is molded as a unitary part of hinge plate 17 and is formed of a semi-rigid yet slightly flexible plastic material. An opening 27 is formed in the hinge plate 17 beneath the beam 22, which allows the beam to flex between its two ends, which remain anchored to the hinge plate, thus creating the live beam. An inwardly projecting protrusion 26 is formed on the inside surface of the shield 14 and is positioned to bear against and ride along the surface of the live beam as the shield is raised and lowered. More specifically, when the shield is in its fully closed position, the protrusion 26 resides in the closed position detent 30 and is held firmly therein by the rearward force of the blade 28 against the flanged hub 24 of the shield. This, in turn, retains the shield in its closed position and holds it firmly against the seal 23 with a predetermined force determined by the restoring force of the torsion spring 20 and the configuration of the closed position detent 30. The shield can be opened by pushing it upwardly with sufficient force to overcome the force provided by the spring 20 and detent 30. When the shield is raised to its fully open position, the protrusion 26 moves into open position detent 38, where, again, it is held by the force of the blade 28 on the flanged hub 24. In this way, the shield is held firmly in its open position.

As the shield moves between its fully closed and its fully opened positions, the protrusion 26 bears against and rides along the surface of the live beam 22. The beam 22, in turn, flexes slightly rearwardly in response to the rearward force imparted to the shield, and thus to the protrusion 26, by blade 28. As the protrusion moves along the surface of the beam, it successively encounters the micro detents 25. The aggregate result is that the shield can be stopped at any desired intermediate position between open and closed and it will be retained in that position by the micro detents 25 and the force of the live beam. Further, the feel of the movement of the shield has been found to be somewhat fluid with the live beam configuration of the present invention and the micro detents provide a desirable micro ratcheting action and feel that is far superior to prior art systems with only a few grossly separated intermediate positions of the shield between closed and opened.

The lever assembly 32 is rotatably attached to the lower extent of the hinge plate 17 and includes a lever 35 that extends downwardly from hub 34. Lever assembly 32 is rotatable about the axis of hub 34 and, as discussed above, can be moved between a home position, a shield cracking position, and a shield restraining position. A rear dowel projects outwardly from a rear portion of the hub 34 and a front dowel 37 projects outwardly from a forward portion of hub 34. With such a configuration, it will be seen that the dowels 36 and 37 also move in respective orbits about the axis of hub 34 as the lever is moved between its three positions. When the shield 14 is closed, the motion plate 33, which is fixed to the lower edge of the shield, moves over hub 34 and its dowels 36 and 37 for interaction therewith as described in detail below.

Figure 3:
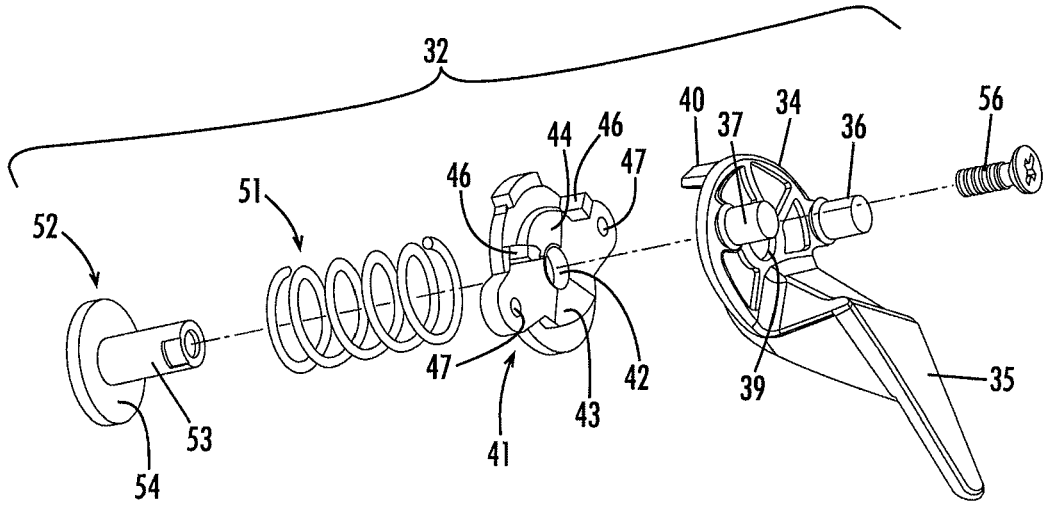
FIG. 3 is an exploded front perspective view of the lever and hub assembly of the precision control system.
Figure 4:
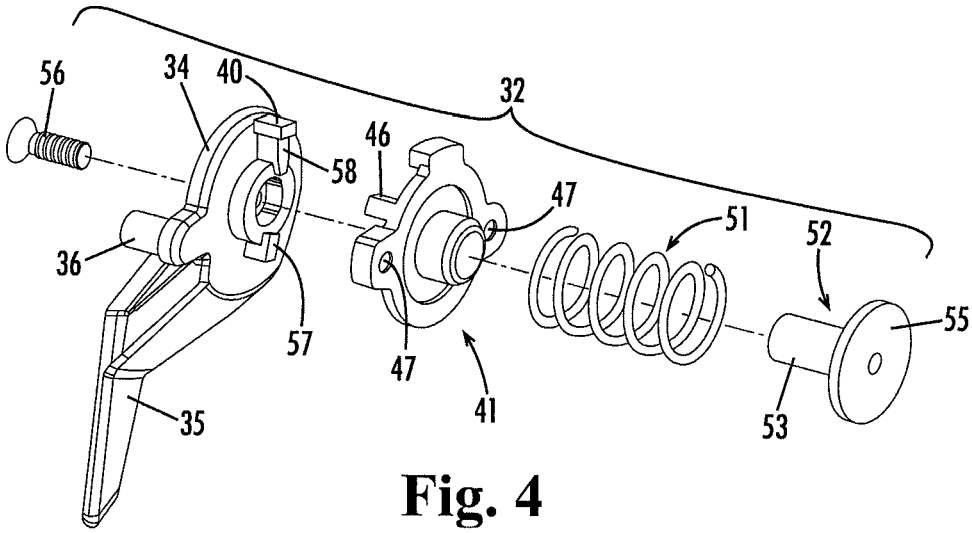
FIG. 4 is an exploded rear perspective view of the lever and hub assembly of the precision control system.

FIGS. 3 through 6 illustrate in detail a preferred construction of the lever assembly 32 and represents the best mode known to the inventor of carrying out the invention. Referring to FIG. 3, the lever assembly 32 comprises the lever 35 with hub 34 and projecting dowels 36 and 37. A hole 39 is formed in the center of the hub 34 and is sized to receive a screw 56 that holds the assembly together and about which the hub 34 and handle 35 rotates. Adjacent to and beneath the hub 34 resides an articulation plate 41 having a central opening 42, stops 46, and attachment holes 47 sized to receive screws for attaching assembly 32 to the hinge plate 17. The articulation plate 41 is formed with a first lobed cam surface 43 and a second lobed cam surface 44, the functions of which are described in detail below. Disposed beneath the articulation plate 41 is a coil spring 51 and, beneath that, an axle 52 having a threaded shaft 53 and a head 54. FIG. 4 shows these components from the reverse side and particularly illustrates the underside of hub 34 that is formed with a first radially extending cam follower 57 and a second radially opposed cam follower 58.

Figure 5:
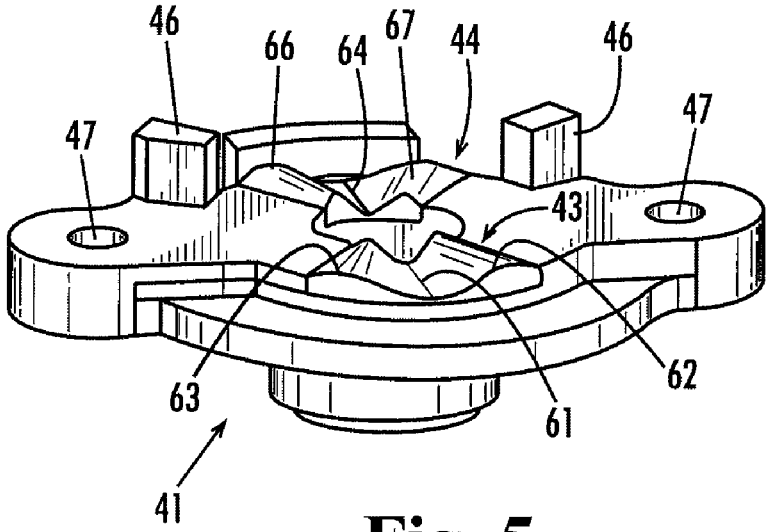
FIG. 5 is an enlarged perspective view of the base plate of the lever and hub assembly of the present invention.

FIG. 5 illustrates the articulation plate 41 of the lever assembly in greater detail. In particular, the first lobed cam surface 43 is seen to exhibit a smoothly transitioning double lobe shape that defines a central trough 61, a first lobe 62, and a second lobe 63. In the preferred embodiment, first lobe 62 is taller and more extremely sloped than second lobe 63 and each lobe, in cross section, exhibits the shape of a sine wave. However, other shapes and geometries for the lobes might well be selected by those of skill in the art. Second lobed cam surface 44 has the same shape as surface 43 with a central trough 64 that is radially aligned with central trough 61, a first lobe 66 that is radially aligned with lobe 62, and a second lobe 67 that is radially aligned with lobe 63. First lobe 66 across from lobe 62 exhibits the same taller height as lobe 62 and the same more extreme slope. Second lobe 67 across from lobe 63 has the same shape and profile as lobe 63.

Figure 6:
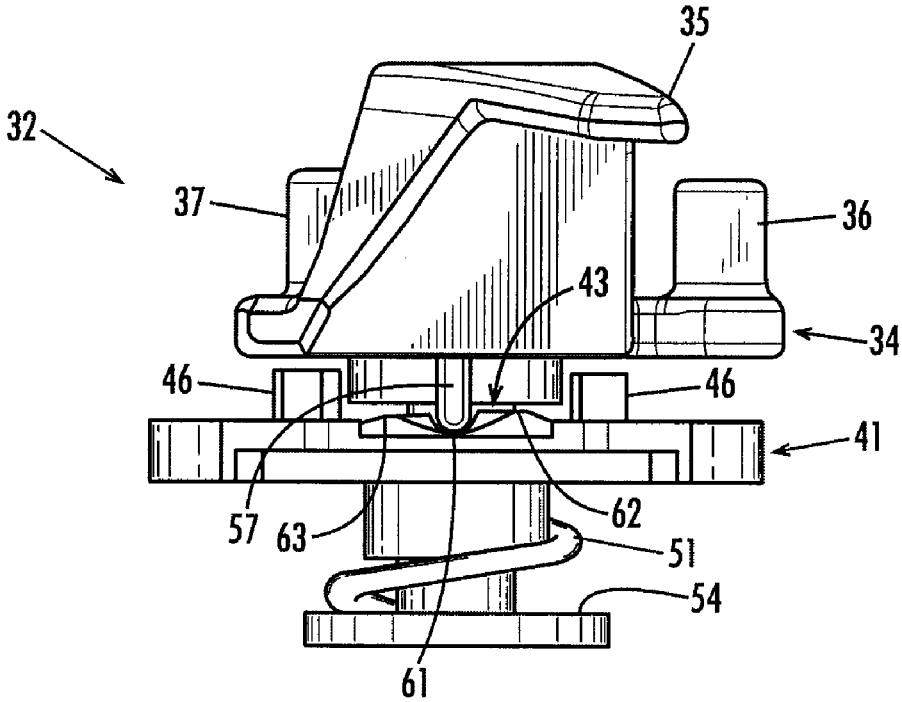
FIG. 6 is an enlarged plan view of the assembled lever and hub assembly of the present invention.

FIG. 6 illustrates the interaction between the various components of the lever assembly 32 to provide the three position movement of the lever and hub (home, shield cracking, and shield restraining) discussed above. The components are seen to be attached together with screw 56 extending through the central opening of the hub and being threaded into the threaded shaft 53 of the axle 52. The coil spring 51 is compressed and captured between the head 54 of the axle 52 and the bottom of the articulation plate 41. The articulation plate is therefore driven into spring biased engagement with the bottom of the hub 34 and particularly with the cam followers 57 and 58 formed on the bottom of the hub 34. FIG. 6 illustrates the handle 34 and its hub 35 in the home position of the handle. In this position, the cam follower 57 resides and is held firmly in the trough 61 by the tension of the torsion spring 51. When the handle is manually moved forward (to the left in FIG. 6) to the shield cracking position, the cam follower 57 rides up the surface of the second lobe 63 until it just passes the apex of the lobe. At this point, stop 40 on the bottom of hub 34 engages stop 46 on the articulation plate halting further rotation. The engaging stops also provide an audible and tactile click to inform a user that the lever is in the proper position. Since the cam follower is to the left of the second lobe 63, the lever is held in its rotated shield cracking position by the tension of torsion spring 51. Similarly, when the handle 35 is moved rearwardly to the shield retaining position, the cam follower 57 rides up the surface of the lobe 62 until it just passes the apex of the lobe and stop 40 engages stop 46 to halt further rotation. The stops provide an audible and tactile click and the handle is held in the shield retaining position by the tension of the torsion spring.

It will be understood that, while not visible in FIG. 6, cam follower 56, which is radially opposite to cam follower 57, executes the same motion with respect to lobed cam surface 44 as does cam follower 57 relative to lobed cam surface 43. It also should be appreciated that since lobe 62 (and corresponding lobe 66) is taller and more extremely sloped than lobe 63 (and corresponding lobe 67), it is more difficult to move the lever into its shield restraining position than to move it to its shield cracking position. This difference provides tactile cues to a user to distinguish between the two positions, and also contributes to the incremental additional closing force applied to the shield when the lever is flipped back to the shield restraining position, as detailed below.

Figure 7:
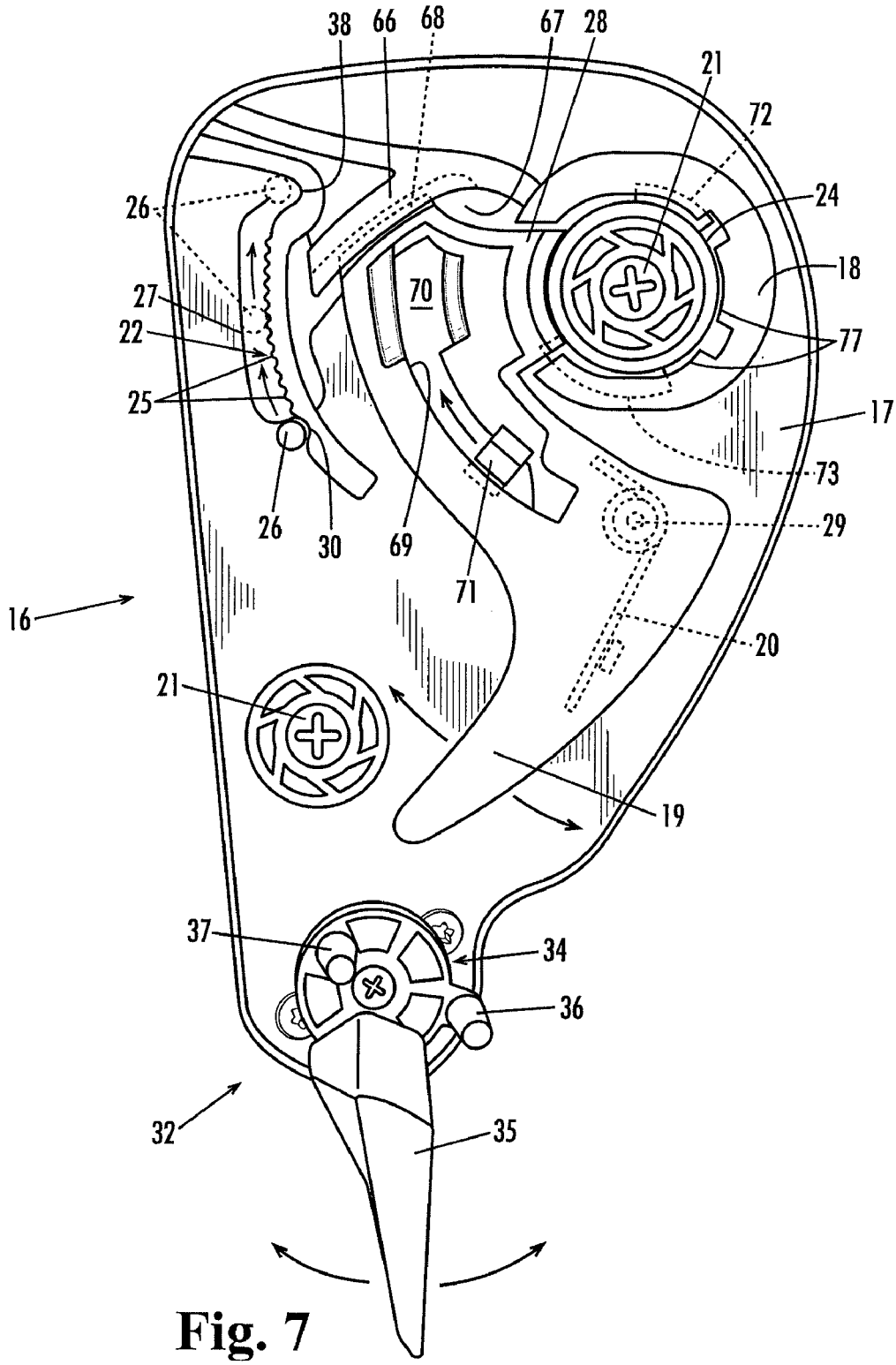
FIG. 7 is a detailed plan view of the shield plate assembly that includes the shield mount and precision control mechanisms.

FIG. 7 shows the shield mount assembly 16 in enlarged detail and illustrates the interaction of the various components during attachment, raising, and lowering of the shield. As discussed above, the shield mount assembly 16 has a hinge plate 17 that is formed with a hinge plate socket 18, and a live beam 22. The hinge plate also is formed with a rib 66 having an undercut lip 67 for purposes detailed below. Release lever 19 is rotatable mounted to the hinge plate 17 at axis 29 by means of a screw through the back of the hinge plate or other appropriate fastening mechanism. The release lever 19 thus is rotatable about axis 19 in the directions indicated by the arrows. A torsion spring 20 is disposed between the release lever 19 and the hinge plate and is arranged and tensioned so that the release lever 29 is yieldable urged to its clockwise-most rotational position.

The hinge plate socket 18 is formed with a series of undercut curved lips 77. Further, and significantly, the socket 18 is not precisely circular in shape, but rather is slightly oblong in the horizontal direction in FIG. 7. More specifically, the oblong shape of the socket 18 can be defined by two circles that are slightly offset horizontally with respect to each other and joined at their top and bottom edges by horizontal tangent lines. The oblong shape of the socket 18 permits the flanged hub 24 of the face shield to move back and forth horizontally within the socket during the various operations of the shield and also facilitates the removal of the shield when desired, as detailed below.

The release lever 19 is further formed with a blade 28 that projects through a gap formed in the wall of the socket 18. It will be seen that rotation of the release lever moves its blade 28 in and out of the hinge plate socket 18. The release lever also is formed with a tongue 68 at its upper end that resides and rides beneath the undercut lip 67 of rib 66. This holds the upper end of the release lever down and prevents it from pulling away from the hinge plate under the influence of forces imparted during operation. An arcuate slot 69 is formed in the release lever and the slot has an open end portion 70 at its upper end.

Live beam 22 is shaped to be generally concentric about the socket 18 and, as mentioned above, flexes between its anchored ends above an opening 27 formed in the hinge plate beneath the beam. The live beam has a distal surface formed with an array of micro detents 25 along its length. A larger closed position detent 30 is formed at the lower extent of the live beam 22 and a still larger open position detent 38 is formed at the upper extent of the live beam. The floating section of the live beam is semi-rigid, but free to flex slightly in response to forces imparted to the beam.

Lever assembly 32, described in detail above, is secured to the bottom of the hinge plate 17 and includes lever 35 and hub 34 with dowels 36 and 37. The lever is movable in the direction of the arrows between a central home position, a forward shield cracking position, and a rearward shield restraining position.

Operation of the shield mount assembly will now be described. It will be recognized that the major outline of the shield itself is not shown in FIG. 7 in order to enhance the clarity of the figure. However, certain features molded on and projecting inwardly from the inside surface of the shield to interact with the shield mount assembly 16 are shown. These include the protrusion 26 that interacts with the live beam, flanged hub 24 that interacts with the hinge plate socket 18, and T-shaped stabilizing lug 71 that interacts with the arcuate slot 69 formed in the release lever 19. The shield is mounted to the mount assembly primarily by means of its flanged hub 24 rotatably captured within the socket 18. More specifically the hub 24 is a generally annular projection from the inside of the shield and is formed with a pair of radially projecting flanges 72 and 73 at its distal end. When the shield is attached to the mount assembly, the radially projecting flanges 72 and 73 are captured and ride beneath the undercut curved lips 77 formed around the top of the socket 18, as illustrated in phantom line in FIG. 7.

When the shield is in its closed position, the radially projecting flanges 72 and 73 are generally vertically oriented and are captured beneath the undercut lips of the socket 18. When the shield is raised to its fully open position, the flange s 72 and 73 are generally horizontally oriented with flange 72 residing under the undercut lip on the right side of the socket. However, in this orientation of the shield, the flange 73 is disposed within the opening in the wall of the socket and captured beneath the blade 28 of the release lever 19. Since the blade 28 is biased by spring 20 toward the hub 24, the hub 24 is held securely in the socket under normal conditions when the shield is flipped open. The flange 73 has a size slightly smaller than the opening in the wall of the socket through which the blade extends. Thus, when the shield is in its open position, it can be removed from the helmet by depressing the release lever to the right against the bias of spring 20, which retracts the blade 28 from the socket 18 and frees the flange 73 of the hub 24. Because of the slightly oblong shape of the socket 18, the hub can move slightly to the left in FIG. 7 until the flange 72 moves out from beneath the lip 77. The hub 24 of the shield is then completely free to decouple from the socket 18 and, as a result, the shield detaches from the helmet. To reattach the shield or install a different shield (e.g. a tinted shield), the shield is positioned around the helmet roughly in its open position to align its flanged hubs with the sockets on either side of the helmet. The hubs are then pressed into the sockets, which causes the blades of the release levers to move out of the sockets until the flanges of the hubs clear the blades. At this point, the blades snap back into the socket under the influence of the springs 20 to capture the hubs in the sockets as described above and thus to attach the shield to the helmet.

The inside of the helmet shell is further formed with inwardly projecting cylindrical protrusion 26 that is position to interact with the live beam 22 of the mount assembly. More specifically, when the shield is in its closed position, the protrusion 26 resides in the closed position detent 30 at the bottom of the beam, as shown in solid line in FIG. 7. The spring biased blade 28 bearing against the hub of the shield pulls the protrusion 26 firmly into the detent 30 to hold the shield in its closed position with a force determined by the restoring force of the torsion spring and the size of the detent 30. When a rider decides to open the shield, a tab on the lower edge of the shield is grasped and pushed upward. This overcomes the closing force and begins to rotate the shield about its hub 24, whereupon the protrusion 26 moves onto the distal surface of the live beam, as illustrated in phantom line in FIG. 7. The rearward force provided by the blade 28 pulls the protrusion against the surface of the live beam, which tends to flex slightly rearwardly under the influence of the force. Further, as the protrusion moves along the surface, it rides across the micro detents 25 formed in the surface. The combination of the rearward force, the flexing live beam, and the micro detents provides a fluid-like motion and feel as the shield opens and, further, the shield can be stopped at virtually any position between closed and open and will be held there by the corresponding micro detents interacting with the protrusion 26. This action and feel has been found to be superior to prior art systems with much more grossly separated intermediate stops between the closed and open positions.

The shield is further formed with a T-shaped (or L-shaped, or any other appropriately shaped) stabilizing lug 71 that projects inwardly from the shield and is positioned to fit and ride within arcuate slot 26 of the release lever 19. In the fully open position of the shield, the stabilizing lug resides in the open top portion of the slot 26 and is thus free to move into and out of the slot as needed when the shield is attached or detached from the helmet. In the closed position and intermediate positions of the shield, however, the stabilizing lug 71 is movably captured within the slot by virtue of at least one of its lateral projections being disposed and riding beneath a lip of the slot, as illustrated in phantom line. This helps to stabilize the sides of the shield against outward flexing and bowing to which the shield is otherwise prone and, in turn, insures that the motion plate 33 on the bottom edge of the shield remains aligned with the hub 34 of the lever assembly and its dowels 36 and 37 when the shield is moved to its closed position. Any outward force applied to through the lug 71 to the release lever 19 is transferred to the hinge plate 17 through the attachment at the axis 29 and through the tongue 68 and undercut lip 67.

Figure 8:
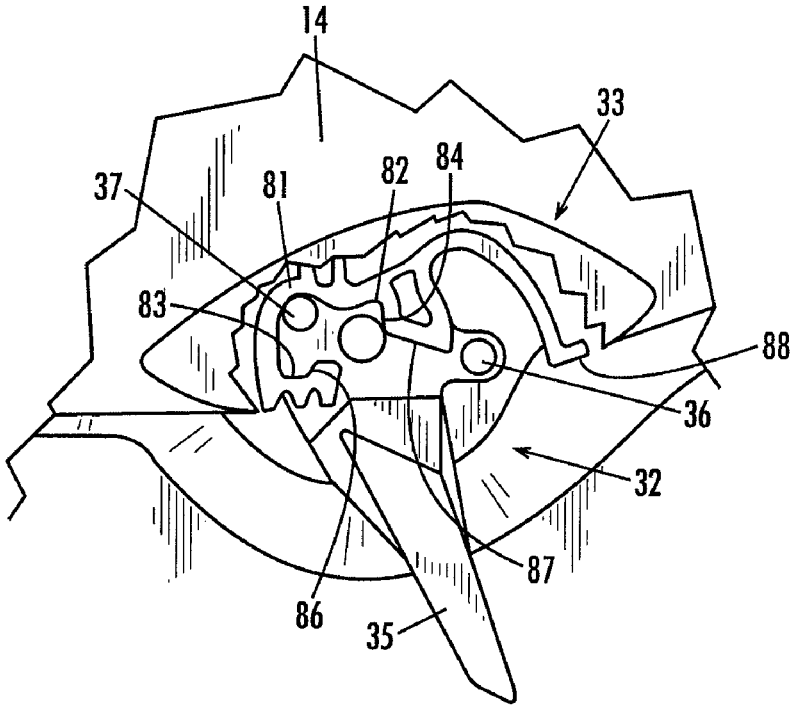
FIG. 8 is a side view of the lever and hub assembly and the motion plate (shown partially cut away) illustrating the locations of the dowels of the hub and surfaces of the motion plate when the lever is in its home position.

FIGS. 8 through 12 illustrate the unique multi-function features and configuration of the precision shield control mechanism of this invention. In each of these figures, the motion plate 33 is shown with its outer casing cut away to reveal the geometry of various surfaces that are formed on and project inwardly from the inside of the motion plate. These surfaces interact with the dowels 36 and 37 of the lever assembly 32 to provide the unique functionality of this invention. The surfaces include a home surface 81, a crack surface 82, a restrain surface 83, a crack bypass surface 84, a restrain bypass surface 86, a crack reset surface 87, and a restrain reset surface 88. FIG. 8 illustrates the relationship between the motion plate 33 and the lever assembly 32 when the shield is closed and the lever 35 is in its centrally located home position. Under these conditions, the forward dowel 37 resides in the crook of the home surface 81 such that it has no effect on the motion plate 33 or the shield. The shield can thus be opened and closed and otherwise operated in the normal way.

Figure 9:
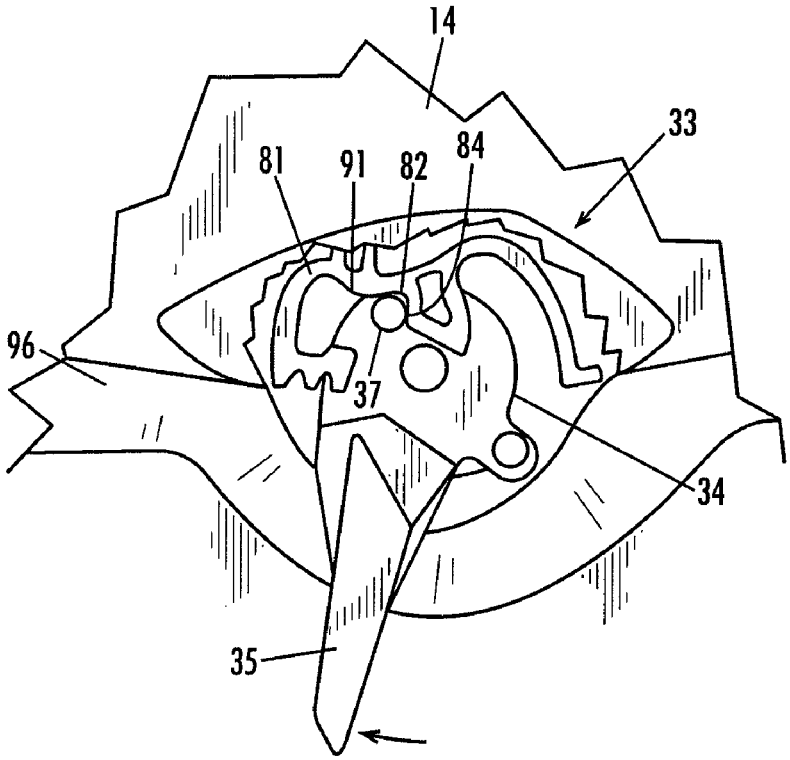
FIG. 9 is a side view of the lever and hub assembly and the motion plate (shown partially cut away) illustrating the locations of the dowels of the hub and surfaces of the motion plate when the lever is in its shield cracking position.

In FIG. 9, the lever 35 has been pushed forward to its shield cracking position with the shield closed. This has caused the dowel 37 to rotate up and to the right about the axis of the hub 34, in the process moving from the crook of the home surface 81 to the crook of the crack surface 82, along ramp 91 between the two surfaces. This action of the dowel 37 pushes up on the motion plate 33 and thus on the shield to raise the shield slightly as indicated at 96, thereby cracking the shield to allow air circulation. The crack surface 82 is configured and positioned to insure that moving the lever 35 to its shield cracking position cracks the shield just enough to break its seal and allow sufficient circulation for eliminating condensation on the inside of the shield, but not enough to admit a blast of air that might interfere with or be uncomfortable to the rider. If, when the shield is cracked, the user opens the shield more fully by applying upward force on the shield tab, then crack bypass surface 82 applies a force to the dowel 37 that is directed upward and to the left in FIG. 9. When this force exceeds the resistance of the lever assembly, the lever assembly snaps back to its home position to allow the shield to continue to open in the usual manner. Thus, opening the shield from its cracked configuration automatically returns the lever from its shield cracking position to its home position. Returning the lever 35 manually to its home position when the shield is cracked lowers the shield back to its fully closed and sealed position shown in FIG. 8.

Figure 10:
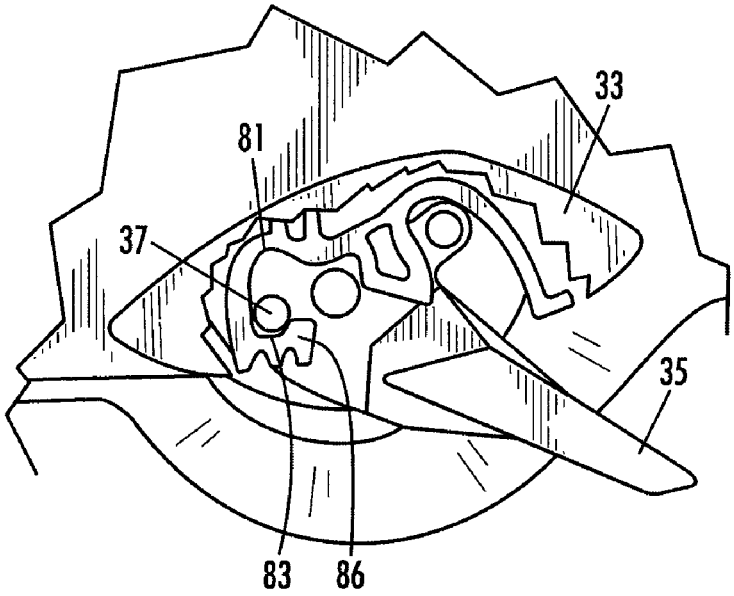
FIG. 10 is a side view of the lever and hub assembly and the motion plate (shown partially cut away) illustrating the locations of the dowels of the hub and surfaces of the motion plate when the lever is in its shield retaining position.

In FIG. 10, the lever 35 has been moved rearward from its home position to its shield restraining position with the shield closed. This has rotated the dowel 37 downwardly into the crook of restrain surface 83. The dowel 37 is held rather firmly in this position by the interaction between the first lobe 62 of the articulation plate 41 and the cam follower 57 of the hub 34 under the influence of spring 51 (see FIG. 6). The downward force of the dowel 37 on the restrain surface 83 increases the total force on the shield tending to keep it closed and thus restrains the shield in its closed position so that aerodynamic forces are not likely to blow the shield open at high speeds. A user, however may still open the shield by pushing up on the shield tab with sufficient upward force. When this happens, the restrain bypass surface 86 begins to push up and to the left on dowel 37 in FIG. 10 tending to rotate the hub 34 and lever assembly back to its home position. When the force imparted to the dowel by the restrain bypass surface is sufficient to overcome the resistance of the lever assembly then the lever assembly snaps back to its home position allowing the shield to be opened in the normal way. It has been found that a required upward force on the shield tab applied by a user that is between about 5 pounds and about 11 pounds and more preferably about 8.5 pounds, results in a restraining force sufficient to restrain the shield in its closed position while at the same time allowing a user to lift and open the shield relatively easily when desired. Movement of the lever manually from its shield restraining position back to its home position when the shield is closed removes the additional restraining force and allows the shield to function in the normal way.

Figure 11:
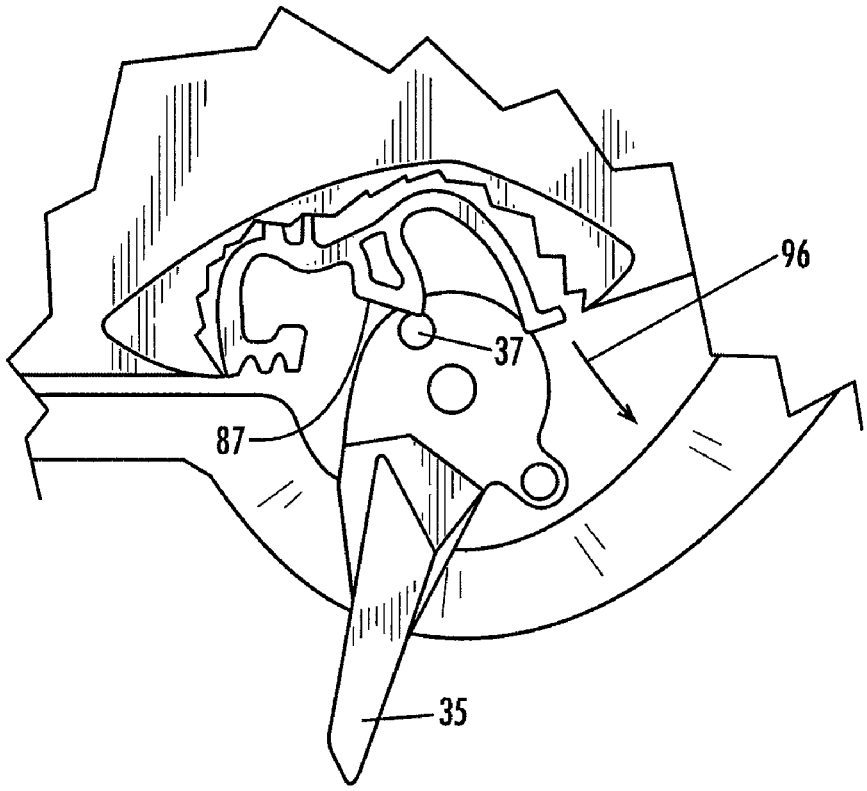
FIG. 11 is a side view of the lever and hub assembly and the motion plate (shown partially cut away) illustrating how the lever is automatically returned from its shield cracking position to its home position when the shield is closed.

In some cases, the lever assembly may accidentally be flipped into either its shield cracking position or its shield restraining position when the shield is open. This could lead to a jamming between the motion plate and the lever assembly when the shield is closed since the dowels of the lever assembly are out of position to be received into the motion plate. The present invention addresses this potential problem. In FIG. 11, the lever is shown as having been accidentally flipped to its shield cracking position with the shield open and the shield is being closed as indicated by arrow 96. The crack reset surface 87 is positioned and shaped so that it engages dowel 37 as the motion plate begins to move over the hub 34 of the lever assembly. As the shield and motion plate close further, the crack reset surface 87 applies a force to the dowel that is directed down and to the left in FIG. 11, which tends to rotate the lever assembly back to its home position. When sufficient force is applied, the lever assembly flips back to its home position allowing the shield to be closed without interference and positioning the lever assembly in its ready position for activation by a user if desired.

Figure 12:
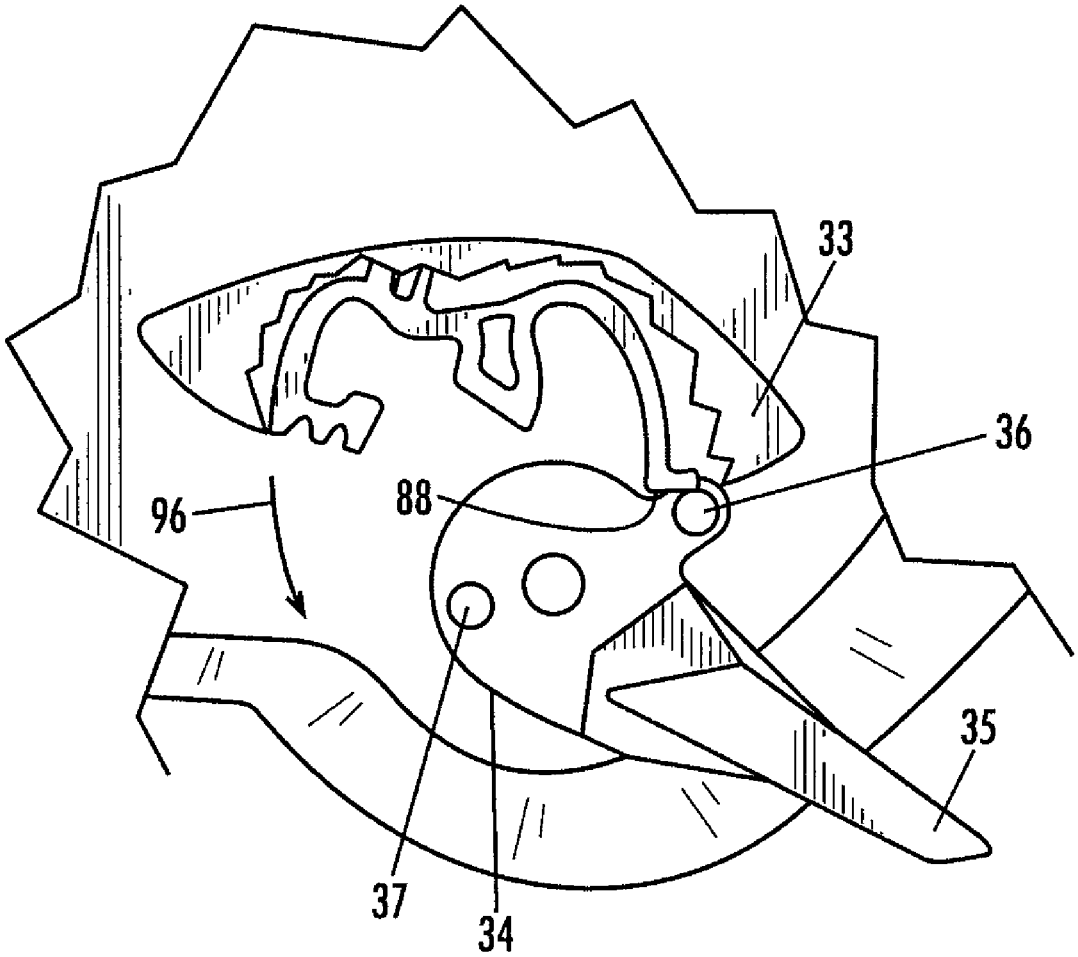
FIG. 12 is a side view of the lever and hub assembly and the motion plate (shown partially cut away) illustrating how the lever is automatically returned from its shield retaining position to its home position when the shield is closed.

In FIG. 12 the lever 35 has been accidentally flipped to its shield restraining position with the shield open and the shield is shown being closed in the direction of arrow 96. As the shield closes, the restrain reset surface 88 engages the dowel 36 and applies a force downwardly and to the right in FIG. 12. The dowel 36 is placed further from the axis of the hub 34 than dowel 37 to form a longer lever arm for overcoming the increased resistance of the lever assembly when in the shield restraining position. When the force applied to the dowel 36 reaches a sufficient level, the lever flips back to its home position allowing the shield to be closed in the usual way and placing the lever in position for activation by a user.

It will thus be seen that if the lever should accidentally be flipped to either its shield cracking position or its shield restraining position when the shield is open, then it is automatically reset to its home position when the shield is closed.

The invention has been described herein in terms of preferred embodiments and methodologies considered by the inventor to be the best mode of carrying out the invention. However, a wide variety of additions, deletions, and modifications might well be made to the illustrated embodiments without departing from the spirit and scope of the invention as set forth in the claims.

What is claimed is:

1. A helmet comprising:

a shell;

an eyeport formed in said shell;

a shield having inwardly projecting hubs;

a pair of sockets on said shell positioned and configured to receive and rotatably capture said inwardly projecting hubs of said shield so that said shield is hingable about said hubs between a closed position covering said eyeport and an open position displaced from said eyeport, each of said sockets being generally oblong to facilitate insertion of said hubs into said sockets to mount said shield to said helmet, and to facilitate removal of said hubs from said sockets to detach said shield from said helmet; and a release lever on said shell, said release lever having a blade movable between a first position at least partially extending into said socket and a second position displaced from said socket, said release lever being spring biased to urge said blade toward its first position for securing said hubs in said sockets.

2. A helmet as claimed in claim 1 and wherein the oblong shape of each of said sockets is defined by two circles offset with respect to each other and joined by tangent lines.

3. A helmet as claimed in claim 1 and wherein said sockets are formed with undercut curved lips and said hubs are formed with radially projecting flanges configured to be captured and to ride beneath the undercut curved lips of said sockets when said shield is mounted to said helmet.

4. A helmet as claimed in claim 1 and wherein each of said hubs is formed with structures configured to be captured by said blade at least partially to secure said hubs in said sockets.

5. A helmet as claimed in claim 4 and wherein said structures comprise at least one radially projecting flange configured to be at least partially captured beneath said blade when said blade is in its first position.

6. A helmet as claimed in claim 5 and wherein said sockets are formed with undercut curved lips configured at least partially to capture said at least one radially projecting flange.

7. A helmet as claimed in claim 1 and further comprising hinge plates mounted to said shell and wherein said sockets are disposed on said hinge plates.

8. A helmet comprising:

a shell with an eyeport;

a shield detachably mounted to the shell for hinged movement between a first position covering the eyeport and a second position displaced from the eyeport; the shield having inwardly projecting hubs that are received and rotatably captured in respective sockets on opposing sides of the shell; the sockets being oblong to facilitate insertion of the hubs into the sockets for attaching the shield to the shell and to facilitate removal of the hubs from the sockets for detaching the shield from the shell; and a blade associated with each socket and being movable between a first position extending partially into the socket and a second position displaced from the socket, each blade being spring biased toward its first position to secure the hubs in position within the sockets until the blades are moved to their second positions whereupon the hubs are released to move out of the sockets.

9. A helmet as claimed in claim 7 and further comprising undercut lips extending at least partially around the sockets and radially projecting flanges on the hubs, the flanges being at least partially captured beneath the lips when the shield is mounted to the shell.

10. A helmet as claimed in claim 8 and wherein the blades are formed on spring biased release levers.

11. A helmet as claimed in claim 10 and wherein the sockets and the release levers are mounted to a hinge plate secured to the helmet shell.

12. A helmet as claimed in claim 8 and wherein the oblong shape of each socket is defined by offset circles joined by tangent lines.

13. A socket for receiving the hub of a helmet shield to mount the shield to the helmet, the socket comprising an opening for receiving the hub, structures surrounding the opening for rotatably capturing the hub within the socket, and a release mechanism for selectively releasing the hub from the socket, the opening of the socket being generally oblong in shape to facilitate receipt of the hub in and release of the hub from the socket, wherein the release mechanism comprises a blade movable between a first position projecting partially into the opening for securing the hub within the socket and a second position retracted from the opening for allowing the hub to be released from the socket, the blade being spring biased toward its first position.

14. The socket of claim 13 and wherein the hub has at lease one radially projecting flange and wherein the structures surrounding the opening comprise at least one undercut lip sized and configured to capture at least partially the at least one radially projecting flange of the hub when the shield is mounted to the helmet.

15. The socket of claim 14 and wherein the blade at least partially captures the at least one radially projecting flange of the hub when the blade is in its first position.

16. The socket of claim 13 and wherein the oblong shaped opening is defined by at least two offset circles connected by tangent lines.

* * * * *